US009426578B2

(12) United States Patent
Liu et al.

(10) Patent No.: US 9,426,578 B2
(45) Date of Patent: Aug. 23, 2016

(54) ELECTROMAGNETIC TRANSDUCER

(71) Applicants: Lin Liu, Shenzhen (CN); Xudong Yan, Shenzhen (CN)

(72) Inventors: Lin Liu, Shenzhen (CN); Xudong Yan, Shenzhen (CN)

(73) Assignee: AAC Acoustic Technologies (Shenzhen) Co., Ltd., Shenzhen (CN)

( * ) Notice: Subject to any disclaimer, the term of this patent is extended or adjusted under 35 U.S.C. 154(b) by 139 days.

(21) Appl. No.: 14/222,161

(22) Filed: Mar. 21, 2014

(65) Prior Publication Data

US 2014/0247960 A1 Sep. 4, 2014

Related U.S. Application Data

(63) Continuation-in-part of application No. 13/332,346, filed on Dec. 20, 2011, now abandoned.

(51) Int. Cl.
*H04R 7/20* (2006.01)
*H04R 9/06* (2006.01)

(52) U.S. Cl.
CPC .. *H04R 9/06* (2013.01); *H04R 7/20* (2013.01); *H04R 2499/15* (2013.01)

(58) Field of Classification Search
CPC ..... H04R 9/06; H04R 9/04; H04R 9/26; H04R 9/02; H04R 31/003; H04R 31/006; H04R 7/04; H04R 7/20; H04R 7/18; H04R 7/24; H04R 7/26; H04R 2307/207; H04R 2307/204
See application file for complete search history.

(56) References Cited

U.S. PATENT DOCUMENTS 8,041,068 B2 * 10/2011 Funahashi ..... H04R 9/043 381/398
8,081,791 B2 * 12/2011 Funahashi ..... H04R 9/043 181/171
8,111,868 B2 * 2/2012 Kaiya ..... H04R 7/18 181/171
8,582,799 B2 * 11/2013 Tanabe ..... H04R 9/025 381/386
2011/0051987 A1 * 3/2011 Ueda ..... B06B 1/045 381/412
2011/0206231 A1 * 8/2011 Yoshida ..... H04R 7/16 381/397
2011/0274309 A1 * 11/2011 Doh ..... H04R 9/047 381/398
2011/0293134 A1 * 12/2011 Huang ..... H04R 9/063 381/412
2012/0002837 A1 * 1/2012 Ouchi ..... H04R 1/06 381/412

* cited by examiner

*Primary Examiner* — Davetta W Goins
*Assistant Examiner* — Jasmine Pritchard
(74) *Attorney, Agent, or Firm* — IPro, PLLC; Na Xu

(57) ABSTRACT

An electromagnetic transducer is disclosed. The electromagnetic transducer includes a frame, a diaphragm attached to the frame, a magnetic circuit part receiving in the frame with a magnetic gap, a voice coil partially inserted into the magnetic gap for driving the diaphragm, and an elastic member including a first arm attached to the diaphragm and at least a pair of second arms extending outwards from the first arm and partially attached to the frame. Each of the second arms has a first part, a stress-relieving portion connected to the first part and protruding outwards from a plane where the first part is disposed in, and a second part connected with the stress-relieving portion and the first arm. The first parts are coplanar with the second part. The stress-relieving portion could enhance the flexibility of the second arm so that the second arm is not easy to be broken.

20 Claims, 6 Drawing Sheets

ELECTROMAGNETIC TRANSDUCER

CROSS-REFERENCE

This application is a continuation-in-part of U.S. patent application Ser. No. 13/332,346, filed on Dec. 20, 2011, the content of which is hereby incorporated by reference in its entirety.

FIELD OF THE INVENTION

The present disclosure relates to an electromagnetic transducer, and more particularly to an electromagnetic transducer with an elastic member.

DESCRIPTION OF RELATED ART

As the science-technology and society advance with high speed, greater use of the electronic devices boosts the quick development of electromagnetic transducers. Multiple functions and long life of electromagnetic transducers are required for people enjoying the technical sense of both vision and ear.

A related electromagnetic transducer mounted to a television includes a vibrating unit and an elastic member with a number of elastic arms for supporting the vibrating unit. When the vibrating unit is vibrating, the root of the elastic arm generally suffers greater stress than other parts thereof. And long time of vibration of the elastic arm results in mechanical fatigue, which easily causes the root broken up.

Therefore, it is necessary to provide a new electromagnetic transducer for solving the problems mentioned above.

DETAILED DESCRIPTION OF THE EMBODIMENTS

Reference will now be made to describe the exemplary embodiments of the present disclosure in detail.

Figure 1:
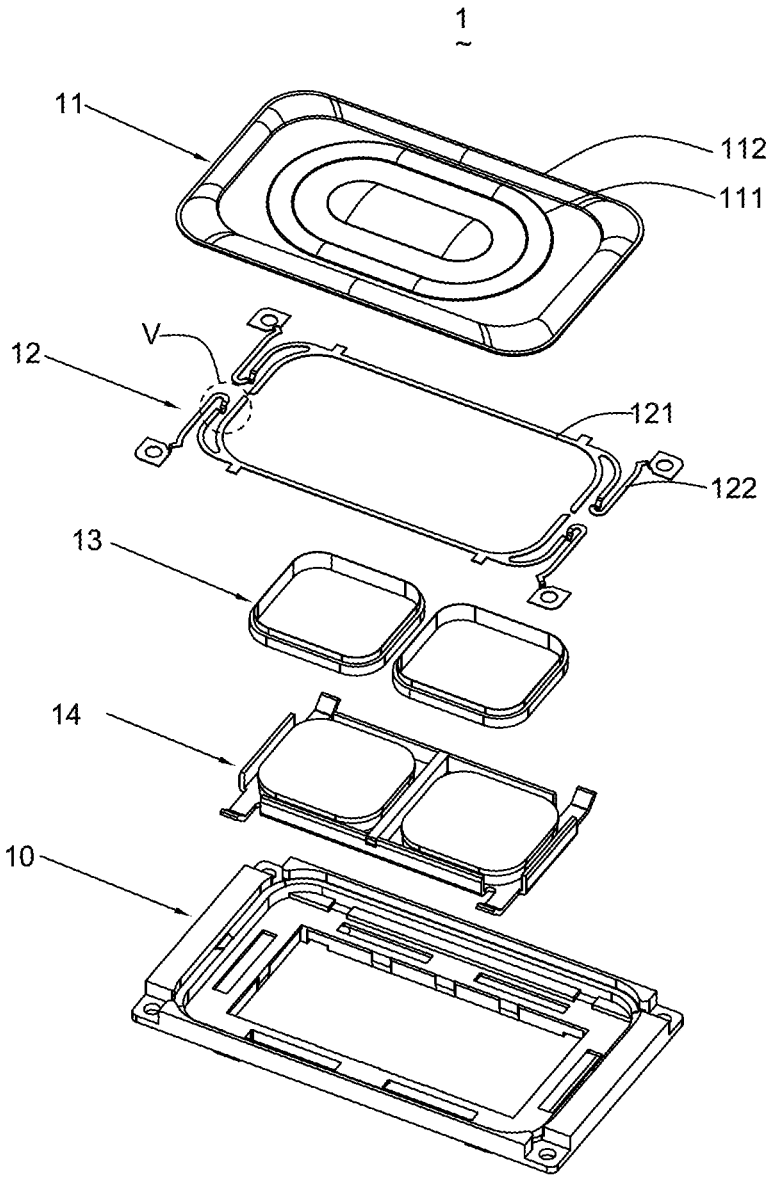
FIG. 1 is an isometric exploded view of an electromagnetic transducer in accordance with an exemplary embodiment of the present disclosure.
Figure 2:
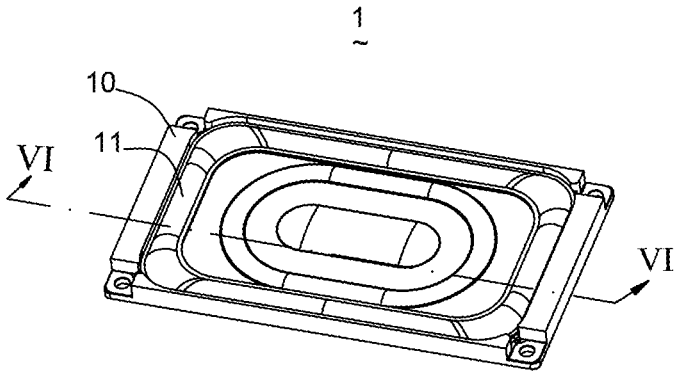
FIG. 2 is an isometric assembled view of the electromagnetic transducer shown in FIG. 1.
Figure 3:
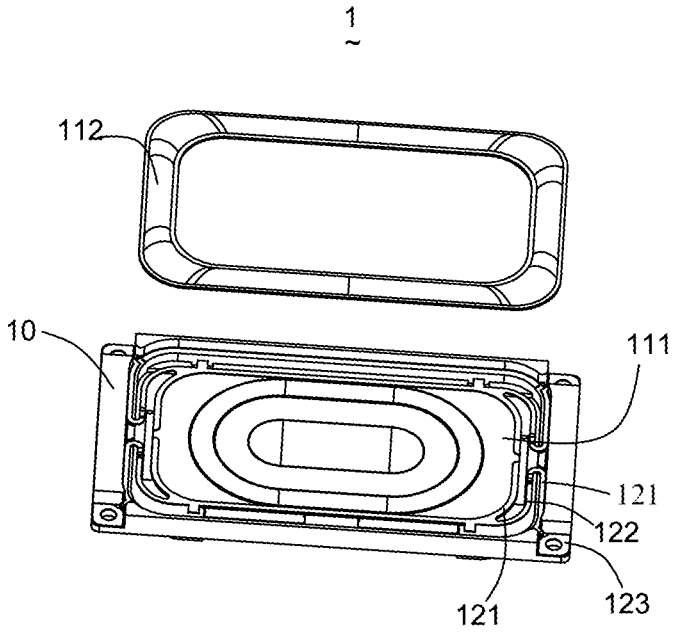
FIG. 3 is a partially assembled view shown in FIG. 2, with a periphery portion of a diaphragm of the electromagnetic transducer separated from other parts.
Figure 4:
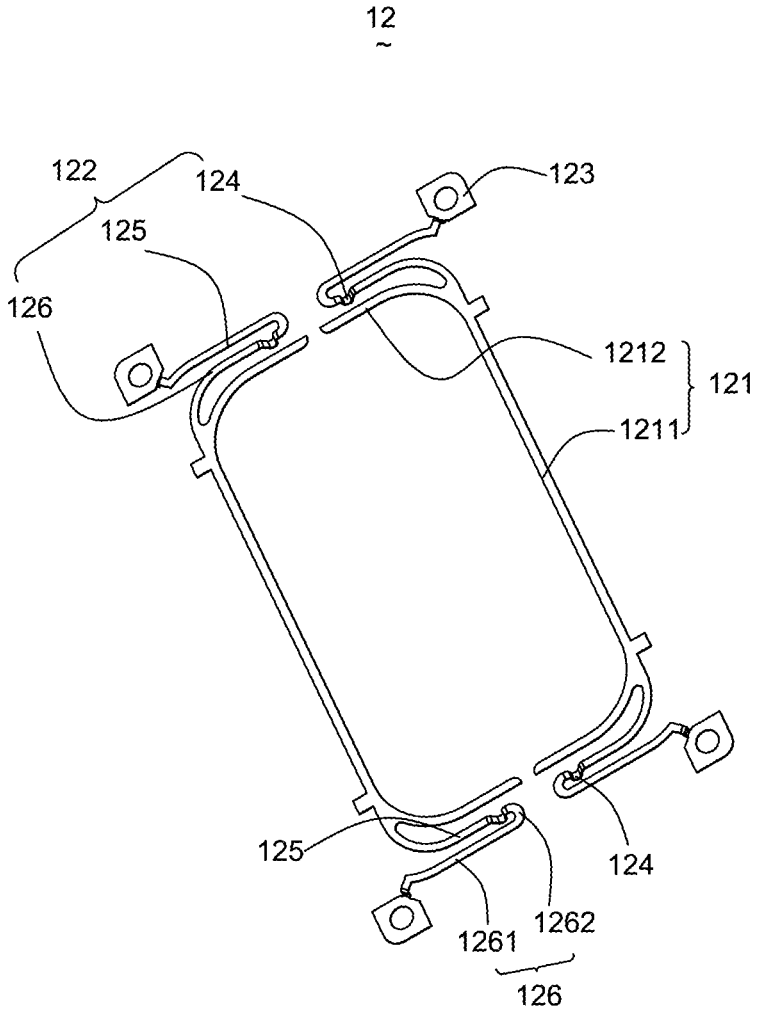
FIG. 4 is an isometric view of an elastic member of the electromagnetic transducer in accordance with an exemplary embodiment of the present disclosure shown in FIG. 1.
Figure 5:
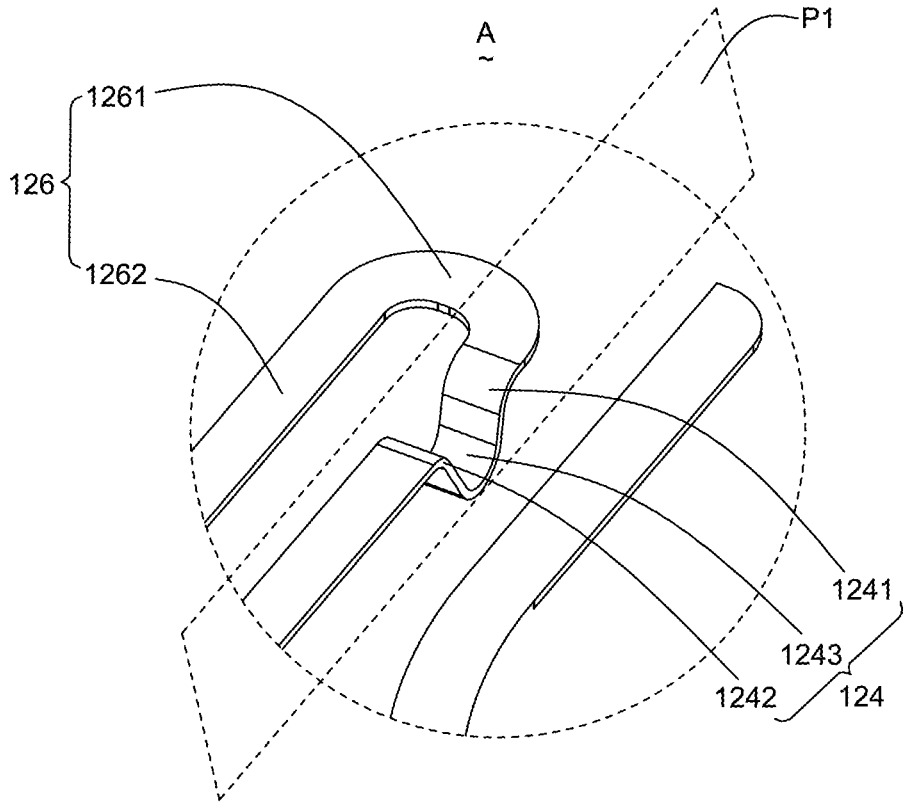
FIG. 5 is an enlarged view of part V shown in FIG. 1.
Figure 6:
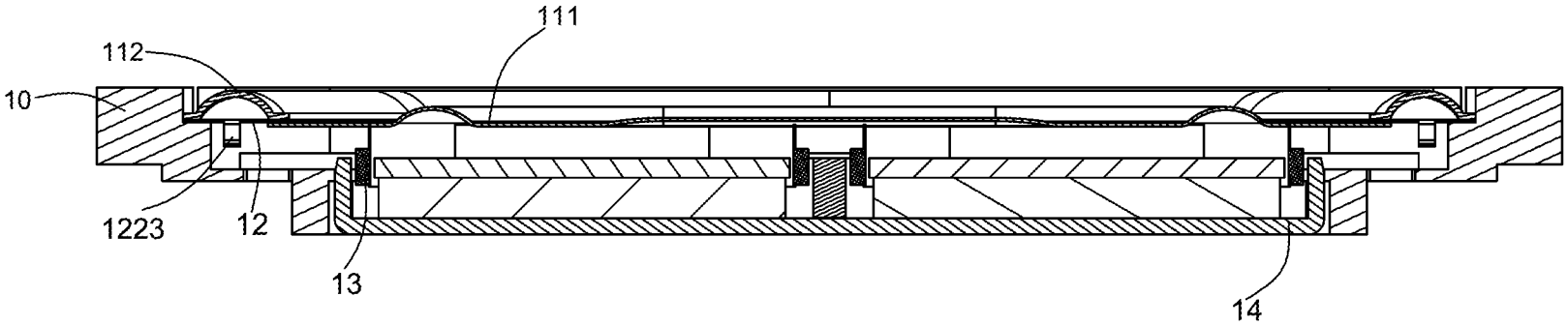
FIG. 6 is a cross-sectional view of the electromagnetic transducer taken along line VI-VI in FIG. 2.

Referring to FIGS. 1 and 2, an electromagnetic transducer 1 comprises a frame 10, a diaphragm 11 assembled with the frame 10, a pair of elastic members 12 assembled with the frame 10 and connected with the diaphragm 11, a magnetic circuit part 14 receiving in the frame 10 and having a pair of magnetic gaps, and a pair of voice coils 13 each having one end partially inserted into the corresponding magnetic gap for driving the diaphragm 11. The combination of the diaphragm 11 and the voice coils 13 serves as a vibrating unit and are capable of vibrating along the vibrating direction for generating sound waves. The diaphragm 11 includes a top plate 111 and a periphery portion 112 surrounding the top plate 111. The a periphery portion 112 has an outer fringe attached to the frame 10 and an inner fringe connected to the top plate 111.

Referring to FIGS. 3-6, each of the elastic members 12 in accordance with an exemplary embodiment of the present disclosure has a U-shaped first arm 121 attached on the top plate 111 of the diaphragm 11, a pair of second arms 122 respectively extending outwards from the two angles of the U-shaped first arm 121 along a devious way, and a pair of position plates 123 disposed at the end of the second arms 121 and each having a hole. In other embodiment, the pair of elastic members 12 could be integrated by connecting the U-shaped first arms 121 thereof (just like the configuration shown in FIG. 7).

The first arm 121 is disposed between the inner fringe of the periphery portion 112 and the top plate 111 of the diaphragm 11. Therefore, the first arm 121 is capable of vibrating along with the vibrating unit. In this embodiment, the first arm 121 has a first connecting portion 1211 sandwiched between the top plate 111 of the diaphragm 11 and the inner fringe of the periphery portion 112 and a pair of second connecting portions 1212 extending bendly from the two ends of the first connecting portion 1211, respectively.

The second arm 122 has a first part 126 partially attached to the frame 10 and connected to the position plates 123, a stress-relieving portion 124 connected to the first part 126, and a second part 125 connected to the stress-relieving portion 124. The first part 126 has a continuous portion 1262 connected to the position plates 123 and sandwiched between the outer fringe of the periphery portion 112 and the frame 10 and a U-shaped root portion 1261 extending bendly from the continuous portion 1262 and connected to the stress-relieving portion 124. The root portions 1261 are capable of effectively absorbing a force applied by the voice coils 13 and evening the force, so that the elastic members 12 are not subjected to deformation easily. The stress-relieving portion 124 includes a first extending portion 1241 connecting with the root portion 1261, a second extending portion 1242 connecting with the second part 125, a bottom portion 1243 located between and connecting with the first and second extending portions 1241, 1242. The joint of the first extending portion 1241 and the root portion, and the joint of the second extending portion 1242 and the second part 125 form a reference plane P1 which is coplanar with the plane where the first part 126 locates. The bottom portion 1243 keeps a distance from the reference plane P1, by which the stress-relieving portion 124 protrudes from the reference plane P1.

The first part 126 is coplanar with the second part 125 for balancing the vibration of the elastic members 12. Preferably, the first arm 121, the first part 126 and the second part 125 are coplanar with each other. The second part 125 of the second arm 122 is adjacent to the second connecting portion 1212 of the first arm 121 for forming a slit therebetween, thereby improving the elastic force of the elastic member 12. The second arm 122 has a U-shaped stress-relieving portion 124 adjacent to the root portion 1261 and protrudes along the vibrating direction of the vibrating unit away from the diaphragm 11, thereby the total height of the electromagnetic transducer 1 is reduced.

When the diaphragm 11 is driven to vibrate by the voice coils 13, the first arm 121 drives the second arm 122 vibrating and results in that the first part 126 suffers greatest stress. But the stress-relieving portion 124 could enhance the flexibility of the second arm 122 and share the stress with the root portion 1261 so that the root portion 1261 is not easy to be broken.

Figure 7:
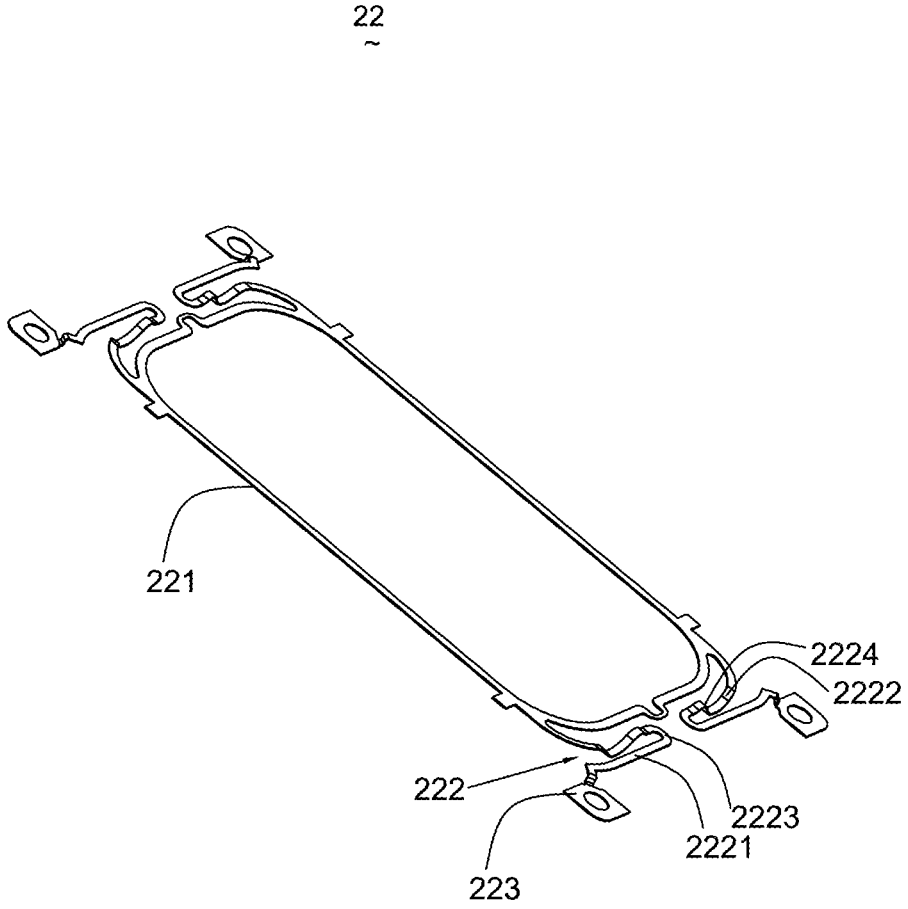
FIG. 7 is an isometric view of an elastic member of the electromagnetic transducer in accordance with another exemplary embodiment of the present disclosure.

Referring to FIG. 7, an elastic member 22 in accordance with another exemplary embodiment of the present disclosure has a pair of U-shaped first arm 221 integrated with each other, four second arms 222 respectively extending outwards from angles of the U-shaped first arms 221 along a devious way, and four position plates 223 disposed at the corresponding end of the second arms 221 and each having a hole. Each of second arms 222 has a first part 2221 attached to the frame 10, a U-shaped root portion 2223 extending bendly from the first part 2221, an undulate-shaped stress-relieving portion 2224 connected to the root portion 2223, and a second part 2222 connected with the stress-relieving portion 2224 and the first arms 221. The first part 2221, the root portion 2223 and the second part 2222 are coplanar with each other. The second part 2222 is adjacent to the first arm 221 and forms a slit therebetween. The stress-relieving portion 2224 protrudes outwards from a plane where the first part 2221 disposed in. The undulate-shaped stress-relieving portion 2224 could enhance the flexibility of the second part 2222 and share the stress with the root portion 2223 so that the root portion 2223 is not easy to be broken.

In other embodiment, the pair of U-shaped first arm 221 could be separated, and the shape of the stress-relieving portion 124,2224 is not limited or restricted to the configuration shown in the figures, and the amount of the stress-relieving portions could be two or more.

While the present disclosure has been described with reference to the specific embodiments, the description of the disclosure is illustrative and is not to be construed as limiting the disclosure. Various of modifications to the present disclosure can be made to the exemplary embodiments by those skilled in the art without departing from the true spirit and scope of the disclosure as defined by the appended claims.

What is claimed is:

1. An electromagnetic transducer, comprising:

a frame;

a diaphragm including a top plate, and a periphery portion surrounding the top plate and attached to the frame;

a magnetic circuit part receiving in the frame and having a magnetic gap;

a voice coil partially inserted into the magnetic gap for driving the diaphragm for vibrating along a vibrating direction; and an elastic member including a first arm attached to the diaphragm and at least two pairs of second arms extending outwards from the first arm and partially attached to the frame, respectively;

wherein each of the second arms has a first part mounted on the frame, a stress-relieving portion connected to the first part and protruding outwards from a plane where the first part is disposed in, and a second part connected with the stress-relieving portion and the first arm; and wherein the first parts are coplanar with respect to the second parts.

2. The electromagnetic transducer as described in claim 1, wherein the stress-relieving portion protrudes along the vibrating direction away from the diaphragm.

3. The electromagnetic transducer as described in claim 2, wherein the stress-relieving portion has a first extending portion extending from the first part and a second extending portion connecting the first extending portion and the second part, and the extending direction of the first extending portion is opposite to that of the second extending portion.

4. The electromagnetic transducer as described in claim 1, wherein the stress-relieving portion is undulate-shaped.

5. The electromagnetic transducer as described in claim 1, wherein the first arm is adjacent to the second part of the second arm for forming a slit therebetween.

6. The electromagnetic transducer as described in claim 1, wherein the first arm is coplanar with the second part of the second arm.

7. The electromagnetic transducer as described in claim 1, wherein the first part has a continuous portion sandwiched between the diaphragm and the frame and a root portion extending bendly from the continuous portion and connected to the stress-relieving portion.

8. The electromagnetic transducer as described in claim 7, wherein the periphery portion of the diaphragm has an out fringe attached to the frame and an inner fringe attached to the top plate with the first arm of the elastic member disposed between the inner fringe and the top plate and the continuous portion of the first part disposed between the outer fringe of the periphery portion and the frame.

9. The electromagnetic transducer as described in claim 1, wherein the elastic member further has a position plate disposed at the end of the second arm and having a hole.

10. An electromagnetic transducer, comprising:

a frame;

a vibrating unit including a diaphragm and a voice coil;

a magnetic circuit unit receiving in the frame;

a pair of elastic members connected with the vibrating unit and separated from each other, each of elastic members including a first arm attached to the diaphragm and at least a pair of second arms extending outwards from the first arm and partially attached to the frame, respectively;

wherein each of the second arms has a first part, a stress-relieving portion connected to the first part and protruding outwards from a plane where the first part is disposed, and a second part connected with the stress-relieving portion and the first arm; and wherein the first parts are coplanar with respect to the second parts.

11. The electromagnetic transducer as described in claim 10, wherein the stress-relieving portion has a first extending portion extending from the first part and a second extending portion connecting the first extending portion and the second part, the extending direction of the first extending portion is opposite to that of the second extending portion.

12. The electromagnetic transducer as described in claim 10, wherein the stress-relieving portion is undulate-shaped.

13. The electromagnetic transducer as described in claim 10, wherein the first arm is adjacent to the second part of the second arm for forming a slit therebetween.

14. The electromagnetic transducer as described in claim 10, wherein the first arm is coplanar with the second part of the second arm.

15. The electromagnetic transducer as described in claim 10, wherein the diaphragm has a top plate and a periphery portion having an outer fringe attached to the frame and an inner fringe attached to the top plate.

16. The electromagnetic transducer as described in claim 13, wherein the first arm of the elastic member is disposed between the inner fringe of the periphery portion and the top plate, and the first part of the second arm is disposed between the outer fringe of the periphery portion and the frame.

17. An electromagnetic transducer, comprising:

a frame;

a magnetic circuit part accommodated in the frame and including a pair of magnetic gaps;

a vibrating unit including a diaphragm attached to the frame and a pair of voice coils partially inserted into the magnetic gaps for driving the diaphragm;

an elastic member including a first arm attached to the diaphragm and at least two pairs of second arms extending outwards from the first arm and partially attached to the frame, respectively;

wherein each of the second arms has a first part, a stress-relieving portion connected to the first part and protruding outwards from a plane where the first part is disposed in, and a second part connected with the stress-relieving portion and the first arm; and wherein the first parts are coplanar with respect to the second parts.

18. The electromagnetic transducer as described in claim 15, wherein the stress-relieving portion is U-shaped and protrudes away from the diaphragm.

19. The electromagnetic transducer as described in claim 15, wherein the stress-relieving portion is undulate-shaped.

20. The electromagnetic transducer as described in claim 16, wherein the diaphragm has a top plate and a periphery portion having an outer fringe attached to the frame and an inner fringe attached to the top plate, the first end of the elastic member is disposed between the inner fringe of the periphery portion and the top plate, the second end of the elastic member is disposed between the outer fringe of the periphery and the frame.

* * * * *